US012680235B2

(12) United States Patent
Hara

(10) Patent No.: US 12,680,235 B2
(45) Date of Patent: Jul. 14, 2026

(54) WATER-PERMEABLE-RETENTIVE PAVEMENT STRUCTURE AND METHOD OF CONSTRUCTING THE STRUCTURE

(71) Applicant: NIHON KENSETSU GIJUTSU CO., LTD., Saga (JP)

(72) Inventor: Yutaka Hara, Saga (JP)

(73) Assignee: NIHON KENSETSU GIJUTSU CO., LTD., Saga (JP)

( * ) Notice: Subject to any disclaimer, the term of this patent is extended or adjusted under 35 U.S.C. 154(b) by 461 days.

(21) Appl. No.: 18/382,350

(22) Filed: Oct. 20, 2023

(65) Prior Publication Data

US 2024/0141597 A1 May 2, 2024

(30) Foreign Application Priority Data

Nov. 1, 2022 (JP) ..... 2022-175487

(51) Int. Cl.

| | |
|---|---|
| ***E01C 3/06*** | (2006.01) |
| ***E01C 3/00*** | (2006.01) |
| ***E01C 7/35*** | (2006.01) |
| ***E01C 19/48*** | (2006.01) |

(52) U.S. Cl.

CPC ..... *E01C 3/06* (2013.01); *E01C 3/003* (2013.01); *E01C 7/35* (2013.01); *E01C 19/4806* (2013.01)

(58) Field of Classification Search

CPC ..... E01C 3/003; E01C 3/06; E01C 11/225
See application file for complete search history.

(56) References Cited

U.S. PATENT DOCUMENTS

| | | | | |
|---|---|---|---|---|
| 8,162,563 B2 * | 4/2012 | Shaw | ..... | E01C 11/18 404/31 |
| 10,557,236 B1 * | 2/2020 | Barsotti | ..... | B32B 13/045 |

FOREIGN PATENT DOCUMENTS

| | | | | |
|---|---|---|---|---|
| CN | 106677154 A * | 5/2017 | ..... | E02D 3/08 |
| CN | 111074716 A * | 4/2020 | ..... | E01C 9/00 |
| EP | 3880887 B1 * | 4/2025 | ..... | E01C 5/065 |
| JP | 2000-120010 A | 4/2000 | | |
| JP | 2003-119712 A | 4/2003 | | |
| JP | 2004-263525 A | 9/2004 | | |
| JP | 3888978 B2 | 3/2007 | | |
| JP | 7090965 B | 6/2022 | | |
| KR | 10-2008-0098218 A | 11/2008 | | |

OTHER PUBLICATIONS

Notice of Reasons for Refusal mailed on May 2, 2023 issued in Japanese Patent Application No. 2022-175487, with English Translation (6 pages).
Office Action issued in Korean Patent Application No. 10-2023-0141700 dated Sep. 20, 2025, with English Translation (11 pages).

* cited by examiner

*Primary Examiner* — Gary S Hartmann
(74) *Attorney, Agent, or Firm* — Nakanishi IP Associates, LLC

(57) ABSTRACT

A water-permeable-retentive pavement structure that includes: a water absorption column formed by filling foam glass in a hole, the foam glass having a continuous pore structure with a grain diameter of 1.0 mm to 2.0 mm, and the hole being formed through a roadbed to a depth below a groundwater level; a road subgrade formed on the roadbed, the road subgrade including the foam glass having a continuous pore structure with a grain diameter of 1.0 mm to 2.0 mm; and a water-permeable pavement formed on the road subgrade.

7 Claims, 1 Drawing Sheet

WATER-PERMEABLE-RETENTIVE PAVEMENT STRUCTURE AND METHOD OF CONSTRUCTING THE STRUCTURE

BACKGROUND OF THE INVENTION

Field of the Invention

The present invention relates to a water-permeable-retentive pavement structure having water permeability and water retentivity and a method of constructing the structure.

Description of the Related Art

In recent years, interest in global warming has increased, and various systems of global warming prevention technology have been developed. One of them is to improve roadside environment and to prevent global warming by reducing temperature rises of paved roads in summer. For example, Japanese Patent Laid-Open No. 2000-120010 discloses a water-permeable asphalt pavement structure provided on a roadbed reclaimed by placing sandy soil or the like, which structure includes: a water-retentive road subgrade made of a road subgrade material, the main material of which is a water-retentive aggregate; and a water-permeable asphalt pavement laid above the water-retentive road subgrade.

Further, for example, Japanese Patent No. 3888978 discloses a road pavement structure including: a water-retaining layer, on a roadbed, formed by laying granular or massive foam glass having continuous pores; a lower layer road subgrade formed on the water-retaining layer; a water-permeable sheet material for civil engineering works laid between the lower layer road subgrade and the water-retaining layer; an upper layer road subgrade formed on the lower layer road subgrade; and a water-permeable asphalt layer formed on the upper layer road subgrade.

According to the above-described conventional pavement structure, water such as rainwater that has passed through the water-permeable asphalt layer or the like is stored in the water-retaining layer or the like, and when the temperature of the road surface rises due to sunshine or the like, the water stored in the water-retaining layer or the like passes through the water-retaining layer or the like, rises, gasifies on the road surface, and evaporates into the atmosphere, which evaporation heat at this time reduces the temperature rise of the road.

In the above-mentioned conventional pavement structure, water is stored in the water-retaining layer or the like, and only this stored water is utilized to reduce the temperature rise of the road. Therefore, it is important how much water can be stored in the water-retaining layer.

There are places where the groundwater level is high in soft ground. An object of the present invention is to provide a water-permeable-retentive pavement structure capable of reducing a temperature rise of a road surface by utilizing groundwater and a method of constructing the structure.

SUMMARY OF THE INVENTION

A water-permeable-retentive pavement structure of the present invention includes: a water absorption column formed by filling foam glass in a hole, the foam glass having a continuous pore structure with a grain diameter of 1.0 mm to 2.0 mm, the hole being formed through a roadbed to a depth below a groundwater level; a road subgrade formed on the roadbed, the road subgrade including foam glass having a continuous pore structure with a grain diameter of 1.0 mm to 2.0 mm; and a water-permeable pavement formed on the road subgrade.

According to the water-permeable-retentive pavement structure of the present invention, the foam glass in the water absorption column allows a capillary action to suck up groundwater, and causes the foam glass in the road subgrade to absorb and retain the water. Here, the foam glass in the water absorption column has a continuous pore structure with a grain diameter of 1.0 mm to 2.0 mm, and is filled in the hole formed through the roadbed to a depth below the groundwater level. The foam glass in the road subgrade has a continuous pore structure with a grain diameter of 1.0 mm to 2.0 mm. When the temperature of the road surface rises due to sunshine or the like, the water passes through the water-permeable pavement formed on the road subgrade, rises, gasifies on the road surface, and evaporates into the atmosphere. The evaporation heat at this time reduces the temperature rise of the road surface.

Further, water supplied to the road surface by rainfall, sprinkled water, etc. passes through the water-permeable pavement, and is absorbed by and retained in the foam glass of the road subgrade and the water absorption column, the foam glass having a continuous pore structure with a grain diameter of 1.0 mm to 2.0 mm. The foam glass having a continuous pore structure with a grain diameter of 1.0 mm to 2.0 mm has a very large water permeability coefficient of about $1\times10^{-1}$ (m/s), and the water permeability is as high as clean gravel, so that water easily passes from the water absorption column to the bottom of the roadbed. Then, the foam glass, in the water absorption column, having a continuous pore structure with a grain diameter of 1.0 mm to 2.0 mm, and the groundwater are brought into contact and mixed to be integrated. After that, the water of the groundwater is constantly sucked up by capillary action as described above, and is absorbed and retained in the foam glass of the road subgrade having a continuous pore structure with a grain diameter of 1.0 mm to 2.0 mm.

The road subgrade includes: a lower layer made of foam glass having a continuous pore structure with a grain diameter of 1.0 mm to 2.0 mm; an intermediate layer, on the lower layer, made of foam glass having a continuous pore structure with a grain diameter of 5.0 mm to 10 mm; and an upper layer, on the intermediate layer, made of foam glass having a continuous pore structure with a grain diameter of 1.0 mm to 2.0 mm. Also with this configuration, the water supplied to the road surface by rainfall, sprinkled water, etc., passes through the water-permeable pavement, and is absorbed by and retained in the foam glass of the road subgrade and the water absorption column, the foam glass having a continuous pore structure with a grain diameter of 1.0 mm to 10 mm. Then, the foam glass, in the water absorption column, having a continuous pore structure with a grain diameter of 1.0 mm to 2.0 mm, and the groundwater are brought into contact and mixed to be integrated. After that, water in the groundwater is constantly sucked up by capillary action, and is absorbed and retained in the foam glass, in the road subgrade, having a continuous pore structure with a grain diameter of 1.0 mm to 10 mm.

The water-permeable-retentive pavement structure of the present invention may include foam glass laid evenly on the water-permeable pavement, the foam glass having a continuous pore structure with a grain diameter of 1.0 mm to 2.0 mm. As a result, the pores on the surface of the water-permeable pavement are filled with foam glass having a continuous pore structure with a grain diameter of 1.0 mm to 2.0 mm. This allows capillary action in the pores on the surface of the water-permeable pavement, so that the pores on the surface of the water-permeable pavement can also exhibit a water retention function and promote gasification on the road surface.

It is desirable that the diameter of the water absorption column be 100 mm to 300 mm, preferably 100 mm to 200 mm, more preferably 100 mm to 150 mm. The water absorption column having a diameter of 100 mm to 300 mm allows constantly keeping groundwater sucked up to the road subgrade through the water absorption column. Note that a diameter less than 100 mm extremely reduces the amount of groundwater which is constantly sucked up to the road subgrade. Contrarily, the diameter exceeding 300 mm disperses the water in the lateral direction, reducing the effect of retaining water in the road subgrade.

It is desirable that the number of water absorption columns per 1 $m^2$ of a plane be one to five. One to five water absorption columns per 1 $m^2$ of a plane allows constantly keeping an appropriate amount of groundwater sucked up to the road subgrade through the water absorption columns. Note that, if the number of water absorption columns is six or more per 1 $m^2$ of a plane, the distance between the adjacent water absorption columns is so close that the capacities to suck up water interfere with each other, possibly reducing the amount of water to be sucked up.

A method of constructing the water-permeable-retentive pavement of the present invention includes: forming a hole through a roadbed to a depth below a groundwater level; forming a water absorption column by filling the hole with foam glass having a continuous pore structure with a grain diameter of 1.0 mm to 2.0 mm; forming a road subgrade on the roadbed with foam glass having a continuous pore structure with a grain diameter of 1.0 mm to 2.0 mm; and forming water-permeable pavement on the road subgrade. This provides the water-permeable-retentive pavement structure of the present invention described above.

The method of constructing the water-permeable-retentive pavement of the present invention is configured so that the road subgrade is formed by: configuring a lower layer by scattering foam glass, laying the foam glass evenly, and subjecting the foam glass to rolling compaction, the foam glass having a continuous pore structure with a grain diameter of 1.0 mm to 2.0 mm; configuring an intermediate layer, on the lower layer, by scattering foam glass, laying the foam glass evenly, and subjecting the foam glass to rolling compaction, the foam glass having a continuous pore structure with a grain diameter of 10 mm to 50 mm; and configuring an upper layer, on the intermediate layer, by scattering foam glass, laying the foam glass evenly, and subjecting the foam glass to rolling compaction, the foam glass having a continuous pore structure with a grain diameter of 1.0 mm to 2.0 mm. This allows a ground to be formed that is composed of: a lower layer made of foam glass having a continuous pore structure with a grain diameter of 1.0 mm to 2.0 mm; an intermediate layer, on the lower layer, made of foam glass having a continuous pore structure with a grain diameter of 5.0 mm to 10 mm; and an upper layer, on the intermediate layer, made of foam glass having a continuous pore structure with a grain diameter of 1.0 mm to 2.0 mm.

Advantageous Effects of Invention (1) According to the water-permeable-retentive pavement structure of the present invention, the foam glass having a continuous pore structure with a grain diameter of 1.0 mm to 2.0 mm in the water absorption column allows a capillary action to suck up groundwater, and the groundwater is absorbed by and retained in the foam glass having a continuous pore structure with a grain diameter of 1.0 mm to 2.0 mm in the road subgrade. Therefore, when the temperature of the road surface rises due to sunshine or the like, the water passes through the water-permeable pavement formed on the road subgrade, rises, gasifies on the road surface, and evaporates into the atmosphere. The evaporation heat at this time can reduce the temperature rise of the road surface.

(2) The water-permeable-retentive pavement structure, which includes foam glass having a continuous pore structure with a grain diameter of 1.0 mm to 2.0 mm laid evenly on the water-permeable pavement, allows capillary action in the pores on the surface of the water-permeable pavement, so that the pores on the surface of the water-permeable pavement can also exhibit a water retention function and promote gasification on the road surface. This allows further reducing the temperature rise of the road surface.

DETAILED DESCRIPTION OF THE PREFERRED EMBODIMENT

Figure 1:
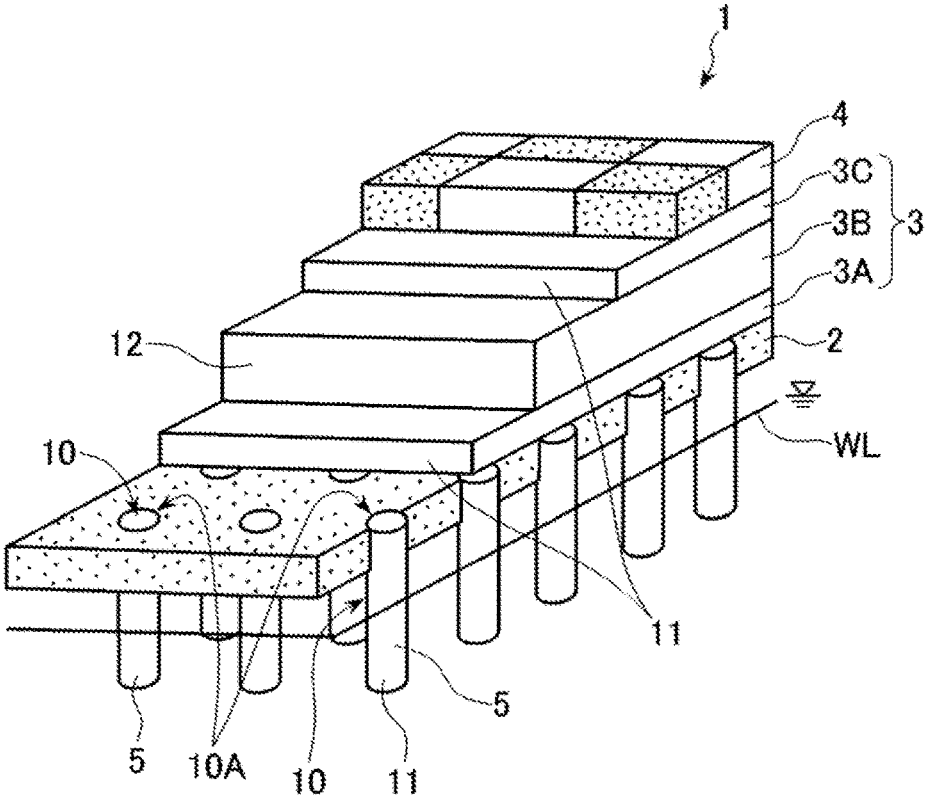
FIG. 1 is a cut-out cross-sectional perspective view showing a water-permeable-retentive pavement structure according to an embodiment of the present invention.

FIG. 1 is a cut-out cross-sectional perspective view showing a water-permeable-retentive pavement structure according to an embodiment of the present invention.

As shown in FIG. 1, a water-permeable-retentive pavement structure 1 according to the embodiment of the present invention has a road subgrade 3 made of foam glass formed on a roadbed 2, and a water-permeable pavement 4 formed on the road subgrade 3. The water-permeable pavement 4 is at least water-permeable asphalt pavement, concrete pavement, interlocking blocks, or the like. In addition, the water-permeable pavement 4 may have water retentivity in addition to water permeability.

In addition, the water-permeable-retentive pavement structure 1 includes water absorption columns 5 formed by filling holes 10 each formed through the roadbed 2 to a depth below the groundwater level WL with foam glass 11 having a continuous pore structure with a grain diameter of 1.0 mm to 2.0 mm. The length of each water absorption column 5 depends on the depth of the groundwater level WL, but is set to a length that can correspond to the fluctuation range of the groundwater level WL, for example, 1.0 m to 3.5 m, preferably 1.5 m or more and 2.5 m or less. The diameter of the water absorption column 5 is 100 mm to 300 mm. There are one to five water absorption columns 5 provided per 1 $m^2$ of a plane.

The road subgrade 3 is composed of: a lower layer 3A made of the foam glass 11 having a continuous pore structure with a grain diameter of 1.0 mm to 2.0 mm; an intermediate layer 3B, on the lower layer 3A, made of foam glass 12 having a continuous pore structure with a grain diameter of 5.0 mm to 10 mm; and an upper layer 3C, on the intermediate layer 3B, made of the foam glass 11 having a continuous pore structure with a grain diameter of 1.0 mm to 2.0 mm. Here, the foam glass 11 and 12 to be used in the water-permeable-retentive pavement structure 1 in the present embodiment has a specific gravity of 0.3 to 0.5 and a water absorption rate of 100% or more and 135% or less.

The lower layer 3A is formed to a thickness of 2 cm to 5 cm by scattering foam glass having a continuous pore structure with a grain diameter of 1.0 mm to 2.0 mm, laying it evenly, and subjecting it to rolling compaction. The intermediate layer 3B is formed to a thickness of 10 cm to 30 cm by scattering foam glass having a continuous pore structure with a grain diameter of 10 mm to 50 mm on the lower layer 3A, laying it evenly, and subjecting it to rolling compaction. The upper layer 3C is formed to a thickness of 2 cm to 5 cm by scattering foam glass having a continuous pore structure with a grain diameter of 1.0 mm to 2.0 mm on the intermediate layer 3B, laying it evenly, and subjecting it to rolling compaction.

The foam glass having a continuous pore structure with a grain diameter of 10 mm to 50 mm in forming the intermediate layer 3B is pulverized by rolling compaction to be the foam glass 12 having the continuous pore structure with a grain diameter of 5.0 mm to 10 mm. Contrarily, the foam glass having a continuous pore structure with a grain diameter of 1.0 mm to 2.0 mm in forming the lower layer 3A and the upper layer 3C is not pulverized so much by the rolling compaction, to have the grain diameter remaining almost unchanged. Therefore, the foam glass becomes the foam glass 11 having a continuous pore structure with a grain diameter of 1.0 mm to 2.0 mm.

In the water-permeable-retentive pavement structure 1 having the above configuration, the foam glass 11 in the water absorption columns 5, which is the foam glass 11, having a continuous pore structure, filled in the holes 10 formed through the roadbed 2 to a depth below the groundwater level WL, allows a capillary action to suck up the groundwater. This allows the foam glass 11 and 12 of the road subgrade 3 to absorb and retain the water. When the temperature of the road surface rises due to sunshine or the like, the water passes through the water-permeable pavement 4 formed on the road subgrade 3, rises, gasifies on the road surface, and evaporates into the atmosphere. The evaporation heat at this time reduces the temperature rise of the road surface.

In addition, water supplied to the road surface through rainfall, sprinkled water, etc. passes through the water-permeable pavement 4 and is absorbed by and retained in the foam glass 11 and 12 in the road subgrade 3 and the water absorption columns 5. The foam glass 11 having a continuous pore structure with a grain diameter of 1.0 mm to 2.0 mm has a very large water permeability coefficient of about $1\times10^{-1}$ (m/s), and the water permeability is as high as clean gravel, so that water easily passes from the water absorption columns 5 to the bottom of the roadbed 2. Then, the foam glass 11 in the water absorption columns 5 and the groundwater are brought into contact and mixed to be integrated. Thereafter, water in the groundwater is constantly sucked up through capillary action, and is absorbed by and retained in the foam glasses 11 and 12 in the road subgrade 3.

In addition, the water-permeable-retentive pavement structure 1 of the present embodiment has the water absorption columns 5 each having a diameter of 100 mm to 300 mm. This allows constantly keeping groundwater sucked up to the road subgrade 3 through the water absorption columns 5. Furthermore, one to five water absorption columns 5 arranged per 1 $m^2$ of a plane allows constantly keeping an appropriate amount of groundwater sucked up to the road subgrade 3 through the water absorption columns 5.

The above water-permeable-retentive pavement structure 1 is formed, for example, by the following procedure.

(1) The water absorption columns 5 are formed by excavating from the roadbed 2 to a depth of 1.0 m below the groundwater level WL (=about 0.4 to 0.7 m) with an auger of ϕ100 to 300 mm, and filling the foam glass 11 having a continuous pore structure with a grain diameter of 1.0 mm to 2.0 mm in the excavated holes 10 up to the opening 10A. At this time, the number of water absorption columns 5 to be formed per 1 $m^2$ of a plane is one to five, for example.

(2) The lower layer 3A made of the foam glass 11 having a continuous pore structure, for example, with a grain diameter of 1.0 mm to 2.0 mm and a thickness of 2 cm, is formed by scattering foam glass having a continuous pore structure with a grain diameter of 1.0 mm to 2.0 mm on the roadbed 2, laying it evenly, and subjecting it to rolling compaction. The intermediate layer 3B made of the foam glass 12 having a continuous pore structure, for example, with a grain diameter of 5.0 mm to 10 mm and a thickness of 10 cm, is formed by scattering the foam glass 12 having a continuous pore structure with a grain diameter of 10 mm to 50 mm on the lower layer 3A, laying it evenly, and subjecting it to rolling compaction. The upper layer 3C made of the foam glass 11 having a continuous pore structure, for example, with a grain diameter of 1.0 mm to 2.0 mm and a thickness of 3 cm, is formed by scattering the foam glass 11 having a continuous pore structure with a grain diameter of 1.0 mm to 2.0 mm on the intermediate layer 3B, laying it evenly, and subjecting it to rolling compaction. In this way, the road subgrade 3 is formed.

Figure 2:
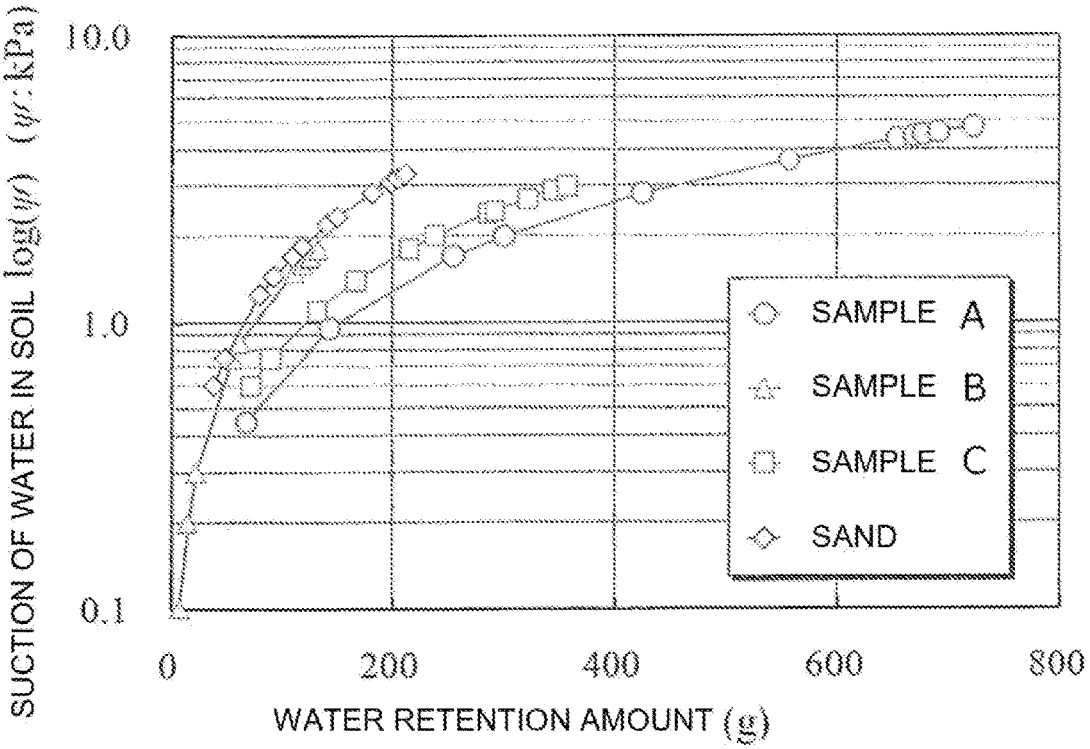
FIG. 2 is a diagram showing suction of water in soil and water retention amounts.

FIG. 2 is a diagram showing suction of water in soil and water retention amounts. Sample A in FIG. 2 is the foam glass 11 having a continuous pore structure with a grain diameter of 1.0 mm to 2.0 mm after rolling compaction. Sample B is the foam glass 12 having a continuous pore structure with a grain diameter of 5.0 mm to 10 mm after rolling compaction. Sample C is foam glass having a continuous pore structure with a grain diameter of 1.0 to 10 mm, formed by mixing foam glass having a continuous pore structure with a grain diameter of 1.0 mm to 2.0 mm and foam glass having a continuous pore structure with a grain diameter of 10 mm to 50 mm at a ratio of 3:7 and subjecting the mixture to rolling compaction. As shown in FIG. 2, only the foam glass 11 of sample A having a continuous pore structure with a grain diameter of 1.0 mm to 2.0 mm had three times the water retention amount of the foam glass 12 of sample B having a continuous pore structure having a grain diameter of 5.0 mm to 10 mm. In addition, sample C had a water retention amount approximately twice that of sample B. However, if the road subgrade 3 is composed only of the foam glass 11 with a small grain diameter, the construction unit price will be high. Therefore, the upper layer 3C with a thickness of 3 cm and the lower layer 3A with a thickness of 2 cm are made of the foam glass 11 having a continuous pore structure with a grain diameter of 1.0 mm to 2.0 mm, and the intermediate layer 3B with a thickness of 10 cm is made of the foam glass 12 with a continuous pore structure having a grain diameter of 10 mm to 50 mm.

(3) The water-permeable pavement 4 is formed on the road subgrade 3. Note that the water-permeable asphalt serving as the water-permeable pavement 4 has so many pores that water retained in the foam glass 11 and 12 of the roadbed 2 and the road subgrade 3 does not rise to the pavement surface. Therefore, it is desirable to scatter foam glass having a continuous pore structure with a grain diameter of 1.0 mm to 2.0 mm on the water-permeable pavement 4 and lay it evenly. This allows capillary action in the pores on the surface of the water-permeable pavement 4, so that the pores on the surface of the water-permeable pavement 4 can also exhibit a water retention function and promote gasification on the road surface. This allows further reducing the temperature rise of the road surface.

EXAMPLES

The water-permeable-retentive pavement structure 1 in the above embodiment was subjected to test construction, and a temperature comparison was made with conventional pavement using a normal temperature asphalt mixture (Remifalt (trade name) manufactured by NIPPO CORPORATION).

Examples 1 to 4 use water-permeable-retentive interlocking blocks as the water-permeable pavement 4. Examples 5 to 7 use water-permeable-retentive asphalt pavement as the water-permeable pavement 4. The test results are shown in Tables 1 and 2, respectively.

<Water-Permeable-Retentive Interlocking Blocks>

TABLE 1

| | Number of water absorption columns (columns/$m^2$) | Number of construction (columns) | Color of block | Sensor position | Temperature difference compared to Remifalt pavement (° C.) |
|---|---|---|---|---|---|
| Example 1 | 1 | 4/4 $m^2$ | White | Part immediately above water absorption column | −11.4 |
| Example 2 | | | Green | Part immediately above water absorption column | −11.1 |
| Example 3 | 2 | 8/4 $m^2$ | White | Part outside of water absorption column | −13.5 |
| Example 4 | | | White | Part immediately above water absorption column | −13.5 |

(1) The water-permeable-retentive interlocking blocks had the largest temperature difference from the Remifalt pavement in Examples 3 and 4, and the difference was −13.5° C.

(2) Examples 1 and 2 shows that the white interlocking blocks had a temperature lower by 0.3° C. between the colors.

(3) Examples 1 and 4 shows that the interlocking blocks with two water absorption columns per $m^2$ had a temperature 2.1° C. lower than those with one water absorption column per $m^2$. A comparison during the daytime (9:00 to 18:00) also showed the interlocking blocks with two water absorption columns per $m^2$ had lower values (maximum 2.6° C.) in all sections.

(4) Examples 3 and 4 showed there was no difference between a part of an interlocking block (white) immediately above the water absorption column and a part outside thereof.

<Water-Permeable-Retentive Asphalt Pavement>

TABLE 2

| | Number of water absorption columns (columns/$m^2$) | Number of construction (columns) | Surface layer | Sensor position | Temperature difference compared to Remifalt pavement (° C.) |
|---|---|---|---|---|---|
| Example 5 | 1 | 4/4 $m^2$ | Water-permeable-retentive pavement | Part immediately above water absorption column | −7.9 |

TABLE 2-continued

| | Number of water absorption columns (columns/m$^2$) | Number of construction (columns) | Surface layer | Sensor position | Temperature difference compared to Remifalt pavement (° C.) |
|---|---|---|---|---|---|
| Example 6 | | | Water-permeable-retentive pavement | Part outside of water absorption column | −6.2 |
| Example 7 | 2 | 8/4 m$^2$ | Water-permeable-retentive pavement | Part immediately above water absorption column | −9.9 |

(1) The water-permeable-retentive asphalt pavement had the largest temperature difference from the Remifalt pavement in Examples 7, and the difference was −9.9° C.

(2) Examples 5 and 6 shows that there was almost no temperature difference as small as 1.7° C. between a part immediately above a water absorption column and a part outside thereof.

(3) Examples 5, 6, and 7 shows that the water-permeable-retentive asphalt pavement with two water absorption columns per m$^2$ had a temperature 2.0° C. lower than the pavement with one water absorption column per m$^2$. A comparison during the daytime (9:00 to 18:00) also showed a tendency in which the water-permeable-retentive asphalt pavement with two water absorption columns per m$^2$ had lower temperature.

INDUSTRIAL APPLICABILITY

The present invention is useful as a water-permeable-retentive pavement structure having water permeability and water retentivity and a method of constructing the structure, and is particularly suitable as a water-permeable-retentive pavement structure capable of reducing a temperature rise of the road surface utilizing groundwater and a method of constructing the structure.

REFERENCE SIGNS LIST

1 water-permeable-retentive pavement structure
2 roadbed
3 road subgrade
3A lower layer
3B intermediate layer
3C upper layer
4 water-permeable pavement
5 water absorption column
10 hole
11, 12 foam glass

What is claimed is:

1. A water-permeable-retentive pavement structure, comprising:

a water absorption column comprising a hole filled with foam glass, the foam glass having a continuous pore structure with a grain diameter of 1.0 mm to 2.0 mm, the hole being formed through a roadbed to a depth below a groundwater level;

a road subgrade formed on the roadbed, the road subgrade including foam glass having a continuous pore structure with a grain diameter of 1.0 mm to 2.0 mm; and a water-permeable pavement formed on the road subgrade;

wherein the road subgrade includes: a lower layer made of foam glass having a continuous pore structure with a grain diameter of 1.0 mm to 2.0 mm; an intermediate layer, on the lower layer, made of foam glass having a continuous pore structure with a grain diameter of 5.0 mm to 10 mm; and an upper layer, on the intermediate layer, made of foam glass having a continuous pore structure with a grain diameter of 1.0 mm to 2.0 mm.

2. The water-permeable-retentive pavement structure according to claim 1, comprising foam glass laid evenly on the water-permeable pavement, the foam glass having a continuous pore structure with a grain diameter of 1.0 mm to 2.0 mm.

3. The water-permeable-retentive pavement structure according to claim 1, wherein the water absorption column has a diameter of 100 mm to 300 mm.

4. The water-permeable-retentive pavement structure according to claim 3, wherein the number of the water absorption columns is one to five per 1 m$^2$ of a plane.

5. The water-permeable-retentive pavement structure according to claim 1, wherein the water absorption column has a length of 1.5 m to 3.5 m.

6. A water-permeable-retentive pavement structure according to claim 1, wherein the lower layer has a thickness of 2 cm to 5 cm, the intermediate layer has a thickness of 10 cm to 30 cm, and the upper layer has a thickness of 2 cm to 5 cm.

7. A method of constructing a water-permeable-retentive pavement, the method comprising:

forming a hole through a roadbed to a depth below a groundwater level;

forming a water absorption column by filling the hole with foam glass having a continuous pore structure with a grain diameter of 1.0 mm to 2.0 mm;

forming a road subgrade on the roadbed with foam glass having a continuous pore structure with a grain diameter of 1.0 mm to 2.0 mm; and forming water-permeable pavement on the road subgrade;

wherein the road subgrade is formed by: configuring a lower layer by scattering foam glass, laying the foam glass evenly, and subjecting the foam glass to rolling compaction, the foam glass having a continuous pore structure with a grain diameter of 1.0 mm to 2.0 mm;

configuring an intermediate layer, on the lower layer, by scattering foam glass, laying the foam glass evenly, and subjecting the foam glass to rolling compaction, the foam glass having a continuous pore structure with a grain diameter of 10 mm to 50 mm; and configuring an upper layer, on the intermediate layer, by scattering foam glass, laying the foam glass evenly, and subjecting the foam glass to rolling compaction, the foam glass having a continuous pore structure with a grain diameter of 1.0 mm to 2.0 mm.

* * * * *